US006290269B1

(12) United States Patent
Bodley-Scott et al.

(10) Patent No.: US 6,290,269 B1
(45) Date of Patent: Sep. 18, 2001

(54) VEHICLE DOOR LOCKING SYSTEM

(75) Inventors: Jamie Bodley-Scott, Burnham; Neil Charles Tigwell, Witney, both of (GB)

(73) Assignee: Lucas Industries, London (GB)

( * ) Notice: Subject to any disclaimer, the term of this patent is extended or adjusted under 35 U.S.C. 154(b) by 0 days.

(21) Appl. No.: 09/180,499

(22) PCT Filed: May 9, 1997

(86) PCT No.: PCT/GB97/01254

§ 371 Date: Aug. 13, 1999

§ 102(e) Date: Aug. 13, 1999

(87) PCT Pub. No.: WO97/43510

PCT Pub. Date: Nov. 20, 1997

(30) Foreign Application Priority Data

May 10, 1996 (GB) ..... 9609842

(51) Int. Cl.[7] ..... E05C 3/06

(52) U.S. Cl. ..... 292/216; 292/DIG. 65

(58) Field of Search ..... 292/216, 201, 292/DIG. 23, DIG. 65; 70/279.1

(56) References Cited

U.S. PATENT DOCUMENTS 4,929,007 * 5/1990 Bartczak ..... 292/336.3
5,474,339 12/1995 Johnson .
5,494,322 * 2/1996 Menke ..... 292/216
5,574,315 * 11/1996 Weber ..... 307/10.1
5,667,260 9/1997 Weyerstall .
5,702,136 * 12/1997 Funk ..... 292/336.3

FOREIGN PATENT DOCUMENTS 32 47018 6/1984 (DE) .
39 18858 12/1990 (DE) .
41 08507 9/1992 (DE) .
295 11451 10/1995 (DE) .

* cited by examiner

*Primary Examiner*—Gary Estremsky
(74) *Attorney, Agent, or Firm*—Wells, St. John, Roberts, Gregory & Matkin, P.S.

(57) ABSTRACT

A vehicle door locking system including a latch mechanism (11) having an operative condition and a release condition, external and internal manually operable controls (14, 16) for releasing the latch mechanism, and controllable coupling means (15, 17) for determining whether or not the internal and/or external controls (16, 14) are linked to the latch mechanism (11); the system includes a control arrangement (21) responsive to locking input signals for determining the relationship between the controls (15, 17) and the latch mechanism (11).

13 Claims, 6 Drawing Sheets

FIG 5
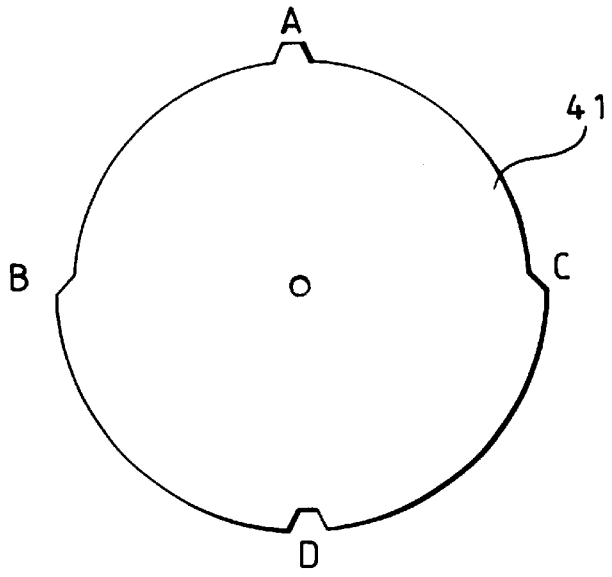
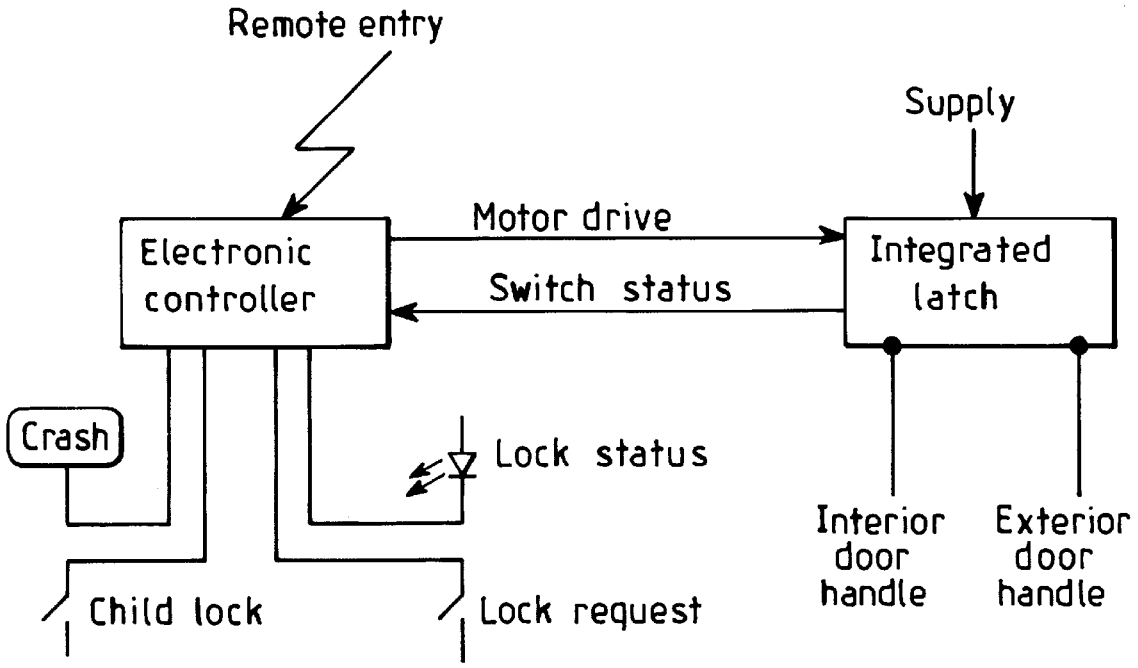
FIG 6

VEHICLE DOOR LOCKING SYSTEM

This invention relates to a locking system for the doors of vehicles, primarily, but not exclusively road vehicles.

Conventionally a vehicle door locking system includes a latch mechanism which physically interconnects the door and the surrounding frame to hold the door in a closed position, the mechanical latch being releasable to permit the door to be opened. A complex mechanical linkage arrangement controls whether the latch mechanism can be released by movement of an internal door handle and/or an external door handle dependent upon the operative state of a number of other mechanisms including an external key-operated lock, a child-lock, an internal sill locking button and possibly other electrically controlled locking or unlocking systems. Although such an arrangement is normally a mechanical arrangement it can be depicted as in FIG. 1 as a logic diagram from which the complexity can readily be appreciated. FIG. 1 illustrates that there may be inputs to the latch mechanism from an internal handle, and an external handle but that the input from the internal handle is dependent upon the setting of a child inhibition (child lock) override. Similarly there are inputs from mechanical locking, electrical locking, and deadlocking systems and the linkage arrangement ensures that operation of the latch mechanism by the internal or the external handle is blocked when any of the mechanical lock, electrical lock, and deadlock systems are operative. Moreover, in the case of an attempt to release the latch mechanism by the internal handle this can only succeed if there is no contrary input from the child inhibition override.

It is an object of the present invention to provide a vehicle door locking system which can achieve at least the same flexibility of control, but in a simple and convenient form.

In accordance with the present invention there is provided a vehicle door locking system including a latch mechanism having an operative condition and a release condition, an external manually operable control for moving the latch mechanism from said operative to said release condition, controllable coupling means for determining whether or not operation of said external control is transmitted to said latch mechanism to move said latch mechanism from said operative to said release condition, an internal manually operable control for moving the latch mechanism from said operative to said release condition, second controllable coupling means for determining whether or not operation of said internal control is transmitted to said latch mechanism to move said latch mechanism from said operative to said release condition, and a control arrangement responsive to predetermined locking input signals for determining when said first and second controllable coupling means are operative to transmit movement of said respective control to the latch mechanism.

Preferably said control arrangement is an electromechanical device and said signals are electrical signals.

Conveniently said first and second controllable coupling means are each mechanical coupling means.

Desirably said control arrangement includes a movable cam member common to both coupling means, for determining when each coupling means is operative.

Preferably said cam member is a rotatable cam.

Most preferably said cam member is rotatable only in one direction.

Conveniently each said coupling means includes a moveable link pin for establishing a driving connection between an input member moveable by the respective manually operable control and an output member driving the latch mechanism.

Alternatively each said coupling means comprises a moveable pawl spring biased to a position in which it provides a mechanical connection between an input member moveable by the respective manually operable control and an output member for moving said latch mechanism, and said cam means selectively prevents the pawl moving under the action of its resilient means so as to prevent connection between the manually operable control and the latch mechanism.

Preferably there is provided means, available to an authorised user, for overriding the action of the control arrangement and thus permitting the or each manually operable control to release said latch mechanism.

Desirably said means includes a mechanical coupling actuated by movement of the or each manual control beyond its normally permitted range of movement.

Preferably there is provision, in the control arrangement, for the acceptance of a signal from a vehicle crash sensor and the use of such signal to operate the system to ensure that the interior manually operable control is coupled to the latch mechanism.

Desirably the system includes means for encrypting the signals supplied to the control arrangement and a decoding system which must be initialised by a security code signal supplied by the vehicle's security system before the signals to the control arrangement can be decoded and implemented.

In the accompanying drawings:

FIG. 5 illustrates an example of part of the control device of the system of FIG. 3;

FIG. 6 is a further diagrammatic representation of the system of FIGS. 2 and 3;

Figure 1:
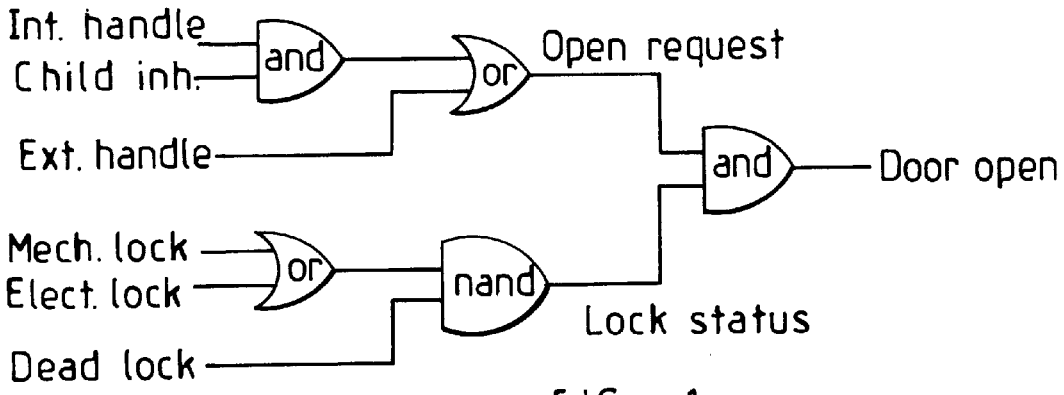
FIG. 1 is a logic diagram representative of a known vehicle door locking system.
Figure 2:
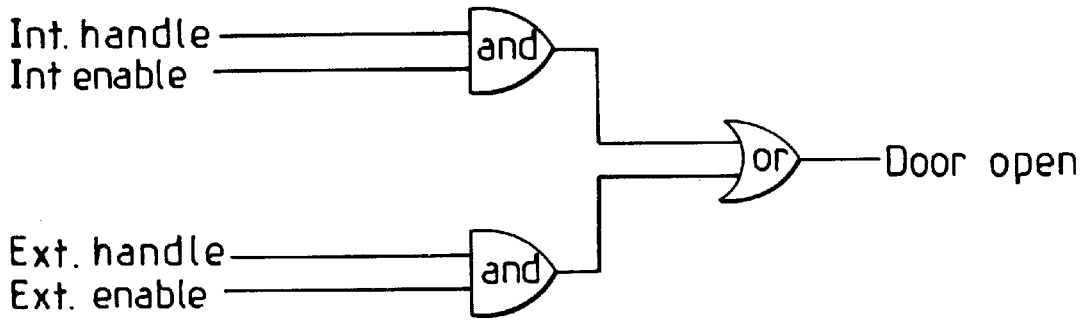
FIG. 2 is a view similar to FIG. 1 of a vehicle locking system in accordance with one example of the present invention.
Figure 3:
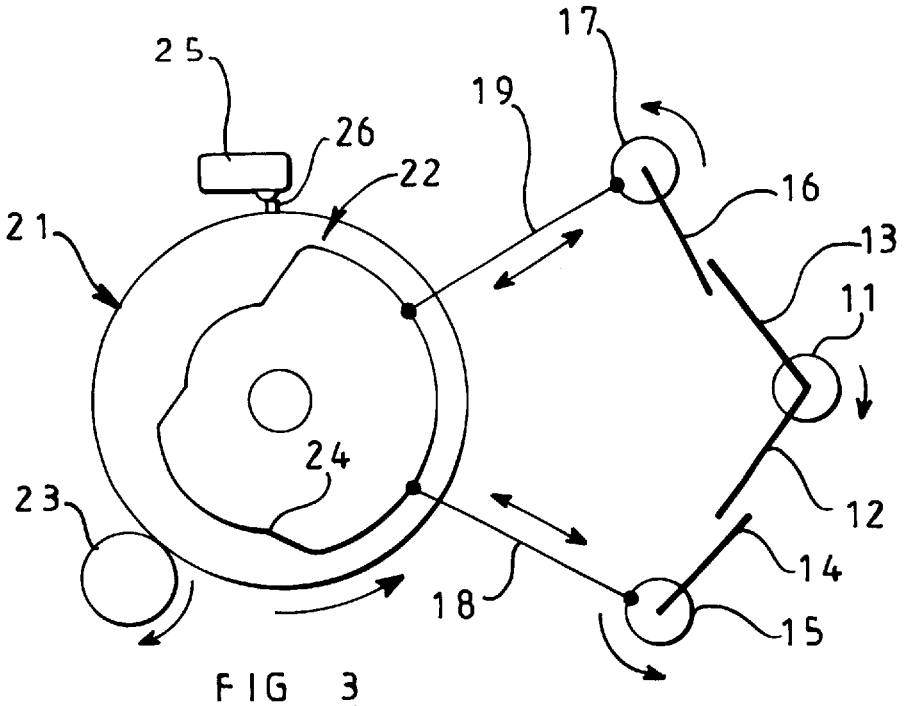
FIG. 3 is a diagrammatic representation of the mechanism of the vehicle door locking system of FIG. 2.
Figure 4:
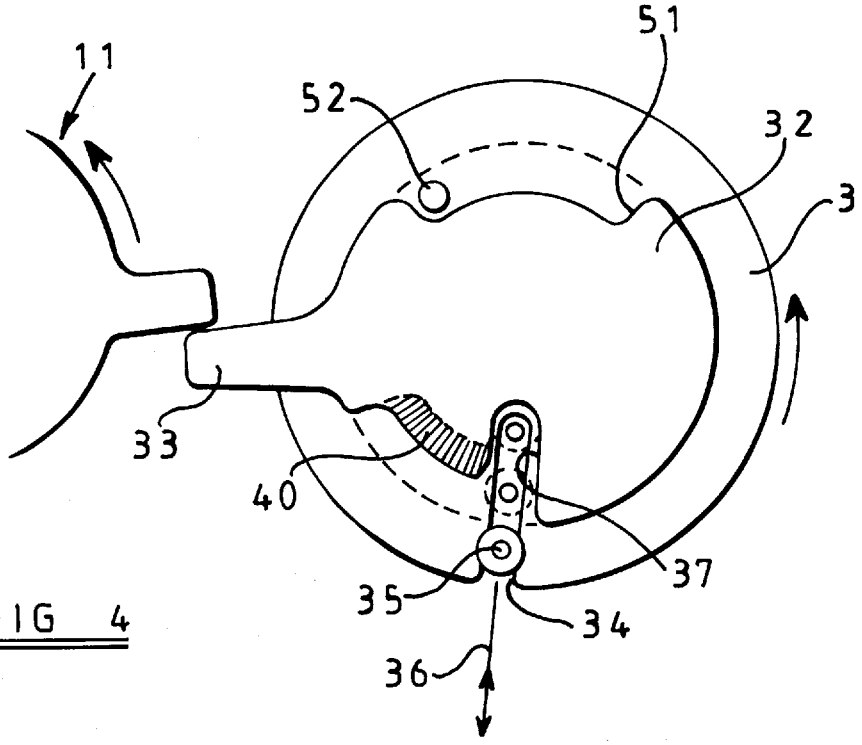
FIG. 4 is a diagrammatic view of a controllable coupling arrangement for use in the mechanism of FIG. 3.

Referring to the drawings, it can seen from FIG. 2 that the concept is that the latch mechanism of the vehicle door can be released to permit the door to be opened as a result of manual input movement either at an internal door handle or at an external door handle, provided that at the time that the internal and/or external door handle is moved that handle is actually enabled in the sense that it is coupled to the latch mechanism so that its movement is transmitted to the latch mechanism to effect release. FIGS. 3 and 4 diagrammatically illustrate an electromechanical door locking system. The latch mechanism is illustrated diagrammatically at 11 and is moveable in a clockwise direction to effect release of the door with which it is associated. The latch mechanism 11 is depicted as incorporating angularly spaced rigid input levers 12, 13 whereby the mechanism 11 may be driven in a release direction. The lever 12 is shown to be co-operable with a lever 14 which can be driven in a counterclockwise direction to abut, and thus drive the lever 12, by a appropriate manual movement of an external door handle provided that a controllable coupling device 15 is, at that time, operative to link the external handle and the lever 14. Assuming that the coupling device 15 is operative, then movement of the external door handle in a release direction is transmitted through the coupling 15 to the lever 14 which in turn drives the latch mechanism 11 by way of the lever 12, the latch mechanism 11 being driven to the release condition.

Similarly the lever 13 of the latch mechanism 11 cooperates with the lever 16 moveable in a counterclockwise direction by manual release movement of an internal door handle provided that a controllable coupling device 17 is, at that time, operable to couple the internal door handle with the lever 16. Assuming that the coupling 17 is operable then movement of the internal door handle in a release direction drives the lever 16 in a counterclockwise direction in turn driving the lever 13 in a clockwise direction to effect release of the latch mechanism 11.

It is to be understood that the depiction of levers 12, 13, 14 and 16 in FIG. 3 is for convenience only. While it is possible that such an arrangement of levers could be utilised in practice, it is equally possible that some form of direct gearing would be provided between the rotary input of the mechanism 11, and the rotary outputs of the coupling devices 15, 17.

It will be readily understood that if neither of the coupling devices 15, 17 is operative then the latch mechanism 11 will remain in its operative condition locking the door closed irrespective of manual operation of the internal and external door handles. Effectively therefore the door will be in a deadlocked condition in that it cannot be opened manually from the interior or the exterior of the vehicle. Similarly, if both of the coupling devices 15, 17 are operable then the latch mechanism 11 can be released by manual operation of either the internal or the external handle. Thus the condition where both coupling devices 15, 17 are operable corresponds to the normal unlocked condition of the vehicle door. Where the coupling device 15 is operable but the coupling device 17 is inoperable then the mechanism 11 can be released by operation of the external door handle, but not by operation of the internal door handle. Such a configuration corresponds to the child-lock condition in that the door can only be opened from the exterior. Finally, the situation in which the coupling device 17 is operable but the coupling device 15 is inoperable is what might be termed a normal door locked condition in that the mechanism 11 can be released by operation of the internal door handle, but not by operation of the external door handle. Thus someone at the exterior cannot gain access to the interior of the vehicle, but an occupant of the vehicle can open the door to leave the vehicle.

FIG. 3 assumes that the coupling devices 15, 17 will be mechanically operated devices for example of the kind to be described hereinafter in relation to FIG. 4, and thus FIG. 3 shows an electromechanical arrangement for controlling the devices 15, 17. It is to be understood however that it is within the ambit of the invention to utilize coupling devices which are controlled electrically rather than mechanically in which case the devices 15, 17 could be controlled electronically, for example by means of a convenient solid state electronic control device.

In FIG. 3 linkages 18, 19 are shown for the purpose of controlling the coupling devices 15, 17 from a rotary cam arrangement 21. FIG. 3 illustrates both the linkages 18, 19 moved to the right-hand end of their permitted travel and this corresponds to placing both of the devices 15, 17 in an operable condition. Thus FIG. 3 illustrates the door locking system in an unlocked condition since both of the internal and external manual release handles can actuate the latch mechanism 11.

At their left-hand ends in FIG. 3 the linkages 18, 19 can be seen to cooperate with an internal cam form 22 of a rotary cam 21. An electric motor 23 can drive the cam 21 in a counterclockwise direction and as will be described hereinafter the rotary cam is intended to occupy any one of four stationary positions spaced apart from one another by 90° of rotation.

It will be recognised that rotation of the cam through 90° in a counterclockwise direction from the position illustrated in FIG. 3 brings a radially inwardly extending ramp surface 24 of the cam into association with the linkage 18 thus moving the linkage 18 to the left and rendering the coupling device 15 inoperable. Thus the outer door handle is not linked to the lever 14 and operation of the outer door handle will not release the latch mechanism 11. However, the region of the cam form 22 cooperating with the linkage 19 has not changed in height, and thus the linkage 19 has not been moved and the coupling device 17 remains operable. It follows therefore that while the first position of the cam (as shown in FIG. 3) is the unlocked position, the second position of the cam (achieved by 90° of counterclockwise rotation from the first position) is the normal-locked position since the door can be opened from the interior, but not from the exterior.

A further 90° of rotation causes the ramp surface 24 to coact with the linkage 19, moving the linkage 19 to the left and rendering the coupling device 17 inoperable. The link 18 is moved even further to the left, but this is not of significance in relation to the device 15 which remains inoperable. Thus in the third position of the rotary cam 21 both of the coupling devices 15, 17 are inoperable and thus the third position of the cam corresponds to the deadlocked position of the door.

A further 90° of rotation of the cam brings the cam to its fourth position in which the linkage 19 is moved further to the left, without altering the operative state of the coupling 17 while at the same time the linkage 18 is moved to the right rendering the coupling device 15 operable. In the fourth position of the rotary cam therefore the child-locked position of the door is achieved in that the latch mechanism cannot be released by operation of the inner door handle, since the coupling device 17 is operable, but can be released by the external door handle since the coupling device 15 is operable.

It will be recognised that a further 90° of counterclockwise rotation returns the parts to the position shown in FIG. 3 to achieve the unlocked position.

As mentioned above the coupling devices 15, 17 are conveniently mechanically actuated, but could if desired be electrically actuated. FIG. 4 diagrammatically illustrates a convenient mechanically actuated coupling device which includes a rotatable, input disc 31 driven by the appropriate manual release handle. A rotatable output disc 32 is positioned parallel to and closely adjacent the disc 31 and has its axis of rotation coextensive with the axis of rotation of the disc 31. The disc 32 incorporates a radially projecting lever 33 which will fulfil the function of the lever 14 or the lever 16 in FIG. 3. As is apparent from FIG. 4 the lever 33 can cooperate with a radially projecting lever (12 or 13) of the latch mechanism 11. It will be understood that where there is direct gearing between a coupling device 15, 17 and the latch mechanism 11 then the lever 33 will be dispensed with and there will be a gear form on the periphery of the disc 32.

The disc 31 is formed with a radially extending slot 34 slidably receiving a coupling pin 35. The position of the coupling pin 35 along the length of the slot 34 is determined by a linkage 36 (which will be the linkage 18 or 19 of FIG. 3). The coupling pin 35 will of course rotate with the disc 31, but its radial position on the disc 31 will be determined by the linkage 36. The coupling pin 35 projects above the level of the disc 31, and can enter a radial slot 37 in the disc 32. The diameter of the disc 32 is less than the diameter of the disc 31, and at the radially outermost position of the pin 35 along the slot 34 the pin is clear of the periphery of the disc 32, and thus the disc 31 can rotate relative to the disc 32. It will be appreciated that this corresponds to the inoperable condition of the coupling device since input movement of the disc 31 resulting from movement of the appropriate release handle will not be transmitted to the output disc 32.

At the radially innermost end of its range of movement the pin 35 enters the slot 37 of the disc 32 and thus establishes a driving connection between the discs 31 and 32. Thus the radially innermost position of the pin 35 corresponds to the operable position of the coupling. FIG. 4 also illustrates an intermediate position of the pin 35 which will be described hereinafter.

It can be seen that a shaded region 40 is shown in FIG. 4 in relation to an arcuate region of the disc 32 clockwise from the slot 37. The shading denotes a ramp surface provided on the underside of the disc 32 which leads the pin 35 beneath the disc 32 in the event that the pin is moved radially inwardly along the slot 36 while the disc 31 is rotated relative to the disc 32 as can occur if, for example, an attempt is made to open a door by moving the respective handle while unlocking is occurring. An advantage of allowing the pin 35 to enter beneath the disc 32 in such circumstances is that upon release of the handle the disc 31 will return to a position where the slot 36 aligns with the slot 37 of the disc 32 and the pin will thus enter the slot 37 to link the discs so a further actuation of the handle will drive the disc 32. In the absence of the ramp 40 the pin 35 would abut the edge of the disc 32 so preventing the radial movement of the pin 35, and stalling the unlocking operation, necessitating a repeat of a locking and then unlocking sequence after release of the handle before the pin 35 would enter the slot 37 to link the discs 31, 32. It will be understood that the pin and/or the disc would be spring mounted to permit the pin to ride under the disc 32 and then to spring back into the slot 37.

It will be recognised that other mechanically controllable coupling devices could be provided. For example, rather than connecting or disconnecting input and output components, the two components could remain permanently interconnected so that the output component always rotates with the input component, but there could be the facility for movement of the output component between a position where it can cooperate with the latch mechanism, and a position where it cannot.

It will be recognised that control over the rotary position of the rotary cam 21 is all that is necessary to achieve the desired locking combinations. Thus it is convenient to achieve all of these locking configurations electrically or electronically, rather than mechanically. The conventional key-operated mechanical lock mechanism at the exterior of the door, and the conventional sill lock button and child-lock lever can be dispensed with to be replaced by electrical inputs.

A control device is associated with the rotary cam 21 and motor 23 for recognising the current rotated position of the cam 21, and for driving the cam 21 to a demanded position. For example the motor 23 could be a stepper motor and a single microswitch 25 could be actuated to give a datum position by a single projection 26 on the exterior of the rotary cam 21. Closure of the microswitch 25 would signal one of the four rotated positions of the cam, and the electronic control device would then supply the appropriate pulses to the stepper motor 23 to achieve the appropriate one of the other three rotated positions.

As an alternative a disc 41 illustrated in FIG. 5 could rotate with the cam 21 cooperating with a single microswitch similar to the microswitch 25. The electronic control device would include signal processing means for recognising a change in the state of the microswitch and the duration of the previous state of the microswitch, and comparing this change of state with the history of the state of the switch during the preceding 90° of rotation. Thus for example when projection A of the disc 41 coacts with the microswitch and the disc 41 is driven in a counterclockwise direction the microswitch will detect the change from high to low as the projection A is displaced from the microswitch and the drive motor will be caused to continue to rotate until the microswitch state is changed again, which will be when ramp C coacts with the microswitch. Thus the processor will recognise that the microswitch was initially recording the high state, then switched to the low state for a predetermined duration, and at the arrival of ramp C switched back to the high state. The change of state will terminate operation of the drive motor until a further input signal is applied.

The next input signal will drive the motor until the recess D in the periphery of the disc 41 coacts with the microswitch whereupon the change of state of the microswitch will again cause operation of the motor to cease. The control device will recognise that this second position of the disc is distinct from the previous position since the history of the microswitch will have been high for a predetermined duration, switching to low when the microswitch cooperates with recess D. A further input pulse will start operation of the motor again so that the microswitch immediately recognises a change from low to high and continues to operate until the state changes again to low, as low point B of the disc 41 cooperates with the microswitch.

A further input signal re-energizes the motor after it has been de-energized and the motor continues to run until projection A coacts with the microswitch, the change of state of the microswitch again suspending operation of the motor. It will be understood therefore that the control device can recognise each of the four positions by comparing the change of state of the microswitch which is occurring, with the history of the state of the microswitch in the previous 90° of movement. Moreover, since the control device can recognise which of the four positions is currently occupied by the rotary cam then it can control energization of the motor 23 to reach an alternative desired position.

It will be recognised that the processing requirements of the control device can be reduced by providing a second microswitch spaced around the periphery of the disc 41 by 90° from the first microswitch, and dispensing with the projection A and the recess D of the disc 41. After an input signal has commenced rotation of the disc 41, and therefore the rotary cam 21 the motor will be de-energized by either of the microswitches changing its operative state, that is to say by virtue of the ramp B or the ramp C cooperating with either of the microswitches. The particular one of the four positions of the disc 41 can then be recognised by comparing the status of the two microswitches. In one of the four positions both microswitches will be open, in the next position one of the microswitches will be open and the other will be closed, in the third position both microswitches will be closed, and in the fourth position the one microswitch will be closed and the other microswitch will be open.

Within the vehicle, available to the driver and/or passengers there will be one or more locking system control switches together with a locking status indicator conveniently in the form of one or more LEDs. For example there could be a first switch which when operated causes the child-lock condition to be achieved, a second switch for the normal lock condition and a third switch for unlocking. Alternatively of course these functions could be provided on a multi-position switch or could be achieved by appropriate pulses of a single switch which steps the locking system through its four possible configurations. Moreover the child-lock condition could be achieved by operation of a switch controlling a separate function, for example the driver's override switch which prevents operation of rear door powered windows by rear door mounted controls.

In relation to control over locking from the exterior of the vehicle the driver would achieve remote control by means of a transmitter on the ignition key, or the key fob and a receiver within the vehicle, in much the same manner as central locking and alarm systems of a vehicle can be remotely actuated at present. The remote actuation might simply be switching between deadlocked and unlocked configurations, although if desired the system could provide for remote actuation of normal locking as opposed to deadlocking, or even remote operation of the child-lock facility.

A recognised problem with conventional mechanical child-locking is that it remains in effect even in an emergency situation. It will be understood that the electronic control device of the locking system described above could be arranged to receive an input from, for example, a crash sensor of the type which conventionally triggers the operation of air-bags and the like, receipt of such a signal being interpreted by the control device processor as an instruction to change the locking status from child-lock to normal-lock or unlocked.

FIG. 6 diagrammatically illustrates how the vehicle door locking system may be implemented in practice. It can be seen that the integrated latch mechanism can receive mechanical inputs from the interior door handle and the exterior door handle, and also receives an electrical supply for powering the motor 23. Control over the operation of the motor 23 is supplied by the electronic controller which in turn receives signals indicative of the status of the or each microswitch 'reading' the rotated position of the rotary cam 21. The electronic controller can receive signals from a remote device, such as the key or the key fob and intended to be operated from the exterior of the vehicle. It also has inputs from a crash sensor, a switch indicative of the desire to achieve a child-lock configuration, a further switch indicted in FIG. 6 as 'Lock request' which may in fact one or more switches, and the controller also provides an output to an LED indicated in FIG. 6 as a 'Lock status' indictor.

The vehicle door locking system described above presupposes that there will always be electrical power available to the vehicle electrical circuit, and also to the remote device carried by the driver.

Considering firstly the situation in which the vehicle battery becomes discharged, or disconnected while the locking system of each door is in a locked configuration. There will be insufficient power to operate the electronic controller, or the motor 23, and to accommodate this each door handle will have an 'over-travel' position which can be reached by moving the handle beyond the normal release position. In the case of the exterior door handles some form of security device will be provided to prevent access to the over-travel position without appropriate authorisation, and this security device could, conveniently, be a mechanical key inserted into the exterior door handle mechanism to permit over-travel, only authorised personnel having access to this key.

FIG. 4 illustrates how over-travel may be utilized. It can be seen that the part of the disc 32 which is uppermost in FIG. 4 has an arcuate cut-out region 51 into which protrudes a post 52 carried by the disc 31. The length and positioning of the cut-out region 51 relative to the post 52 is such that when the disc 32 is free of the disc 31, and the external release handle is moved through its normal range of movement, then the post 52 does not abut the ends of the region 51. However, the extent of the normal travel of the exterior release handle is such that at the point at which over-travel (if permitted) commences the post 52 is in contract with the clockwise end of the region 51, and thus during the over-travel movement the post 52 moving with the disc 31 drives the disc 32 so that the over-travel of the exterior release handle drives the latch mechanism 51 to its release position. Correspondingly, during return movement of the external release handle the post 52 engages the counterclockwise end of the region 51 so that when the handle returns to its rest position the discs 31 and 32 are returned to their rest positions as illustrated in FIG. 4.

Where the post 52 is provided it will be recognised that there is always the possibility of actuation by the post 52 if the over-travel of the respective handle is permitted. In order to provide an additional degree of security it would be possible to provide for over-travel operation by means of an intermediate position of the pin 35 between the fully retracted and the fully engaged positions shown in FIG. 4. The intermediate position is depicted in FIG. 4, and it is to be understood that where the pin 35 is used to achieve over-travel operation then the pin 52 is dispensed with.

The principle of over-travel operation using the pin 35 is extremely similar to that described above in relation to the pin 52, it being recognised that when the pin 35 is in its intermediate position then at one end of the travel of the disc 31 relative to the disc 32 the pin 35 abuts the extended counterclockwise wall of the slot 37, and during clockwise rotation of the plate 31 relative to the plate 32, the pin 35, in its intermediate position, travels in an arcuate cut-out region of the disc 32 which terminates at an abutment close to the lever 33. Engagement of the pin 35 with this abutment would occur at the commencement of the over-travel movement of the respective handle so that during the over-travel movement the pin 35, moving with the disc 31, drives the disc 32.

The pin 35 achieves the intermediate position by virtue of the shaping of the cam 22 (FIG. 3). It will be recognised that when considering the cam 22 we noted that the ramp surface 24 of the cam 22 lay at a height intermediate the extremes of the cam 22. Thus the initial 90° of rotation of the cam 22 from the position shown in FIG. 3 caused the ramp surface 24 to cooperate with the linkage 18 changing the state of the device 15 from operable to inoperable. In fact the pin 35 of the device 15 was withdrawn radially from the innermost position in which it linked the discs 31 and 32, to the intermediate position in which it could provide the over-travel operation provided that the relevant handle driving the drive 31 was permitted to operate in an over-travel mode. Thus in the second rotated position of the cam 22, as referred to above, (the normal-locked position), over-travel operation by the exterior handle would be possible provided that the exterior handle has an over-travel facility.

Movement of the cam to the third position will move the pin 35 of the device 15 to a fully retracted position in which there is no abutment for the pin to engage and so over-travel operation can no longer occur, but in the third position it will be recalled that the ramp 24 has actuated the linkage 19 thus moving the pin 35 of the device 17 to an intermediate position. Thus in the third rotated position of the cam 22 (the deadlocked position) the latch mechanism can be operated by over-travel of the interior door handle provided that the interior door handle has the facility for over-travel.

It is recognised that it is less likely that over-travel operation from an interior door handle would be necessary, although this can be provided if desired, and may be advantageous to facilitate servicing of the locking system in use.

As an alternative the locking system of at least the drivers door of the vehicle could be provided with a back-up battery which provides power for the electronic control device and the motor 23 in the event of failure of the main power supply of the vehicle electrical system. The back-up battery could be, for example, a lithium battery and conceivably could be the battery of the vehicles anti-theft alarm/immobilizer system. Desirably the back-up battery would not permanently energize the electronic controller of the door locking system as this might drain the battery too quickly. Instead the back-up battery could be arranged to be switched into circuit for a predetermined short length of time following a release movement of the exterior handle of the door, this period of time being calculated to be sufficient for recognition of the correct remotely generated signal, and corresponding operation of the motor 23 to render the or each coupling device 15, 17 operable.

As a further alternative the drivers door could be provided with a key-operated mechanism to which only the driver or other authorised personnel have the appropriate key, the key operated mechanism being coupled to the latch mechanism 11 by an electromagnetic device only when it is detected that the battery of the vehicle electrical system is becoming discharged or disconnected.

In order to accommodate the possibility of the battery in the drivers key or key fob transmitter becoming discharged the key or key fob could be provided with a passive transponder of known form which can be energized, and can cooperate with a coil antenna provided at a known location in the door. The coil antenna will not be permanently energized, but will be energized for a predetermined period of time following a release movement of the exterior door handle. Thus the driver will hold his key or key fob in the known proximity of the coil antenna and will operate the door handle. The movement of the door handle will energize the coil antenna which in turn will energize the transponder. Provided that the transponder is recognised by the control system associated with the coil antenna then a signal can be applied to the electronic controller of the locking system either to render the relevant coupling device 15 operable, or to permit over-travel of the handle. It will be understood that such transponder/coil antenna systems are known in relation to control of vehicle security systems.

Figure 7:
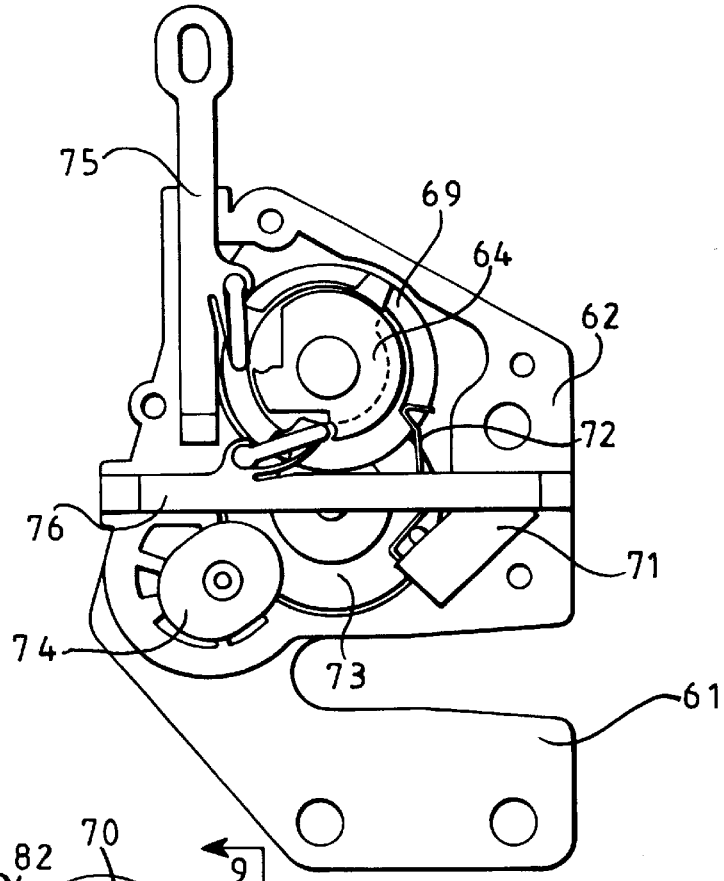
FIG. 7 is a plan view of an alternative vehicle door locking mechanism operable in accordance with the diagram of FIG. 2.
Figure 8:
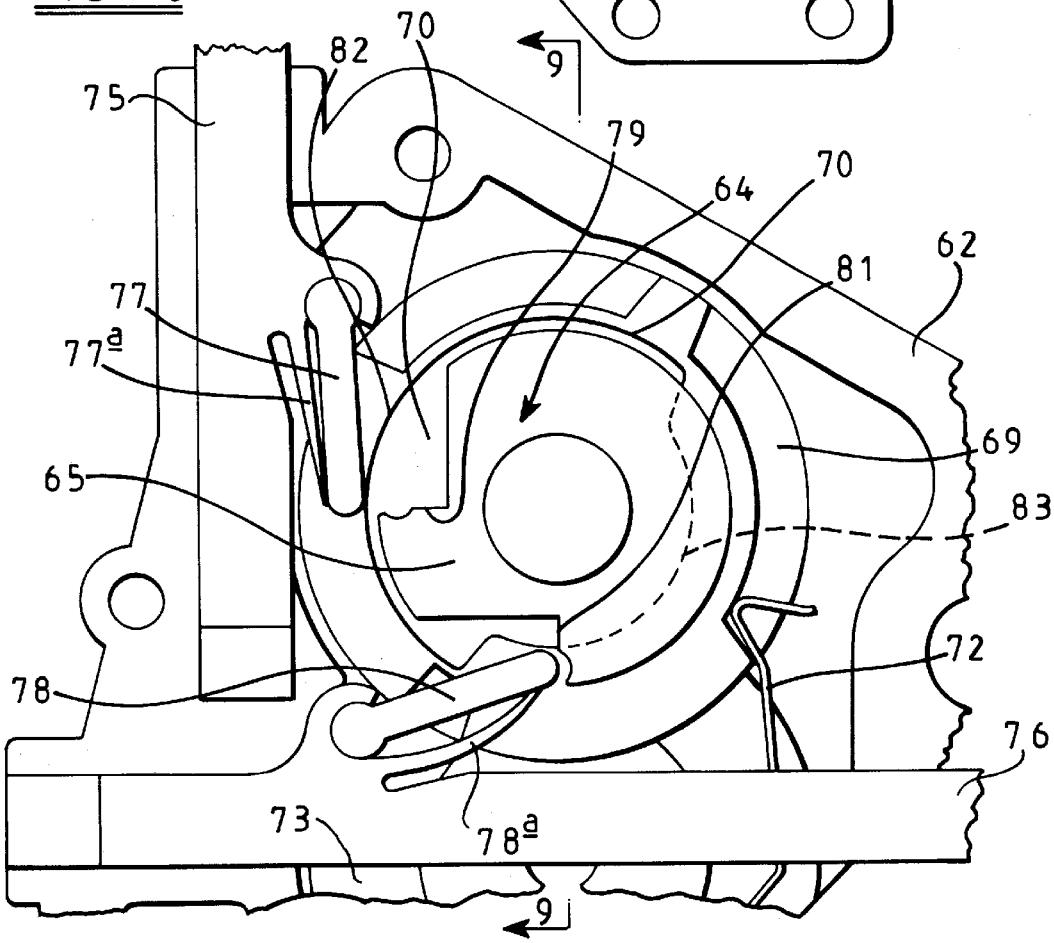
FIG. 8 is an enlargement of part of FIG. 7.
Figure 9:
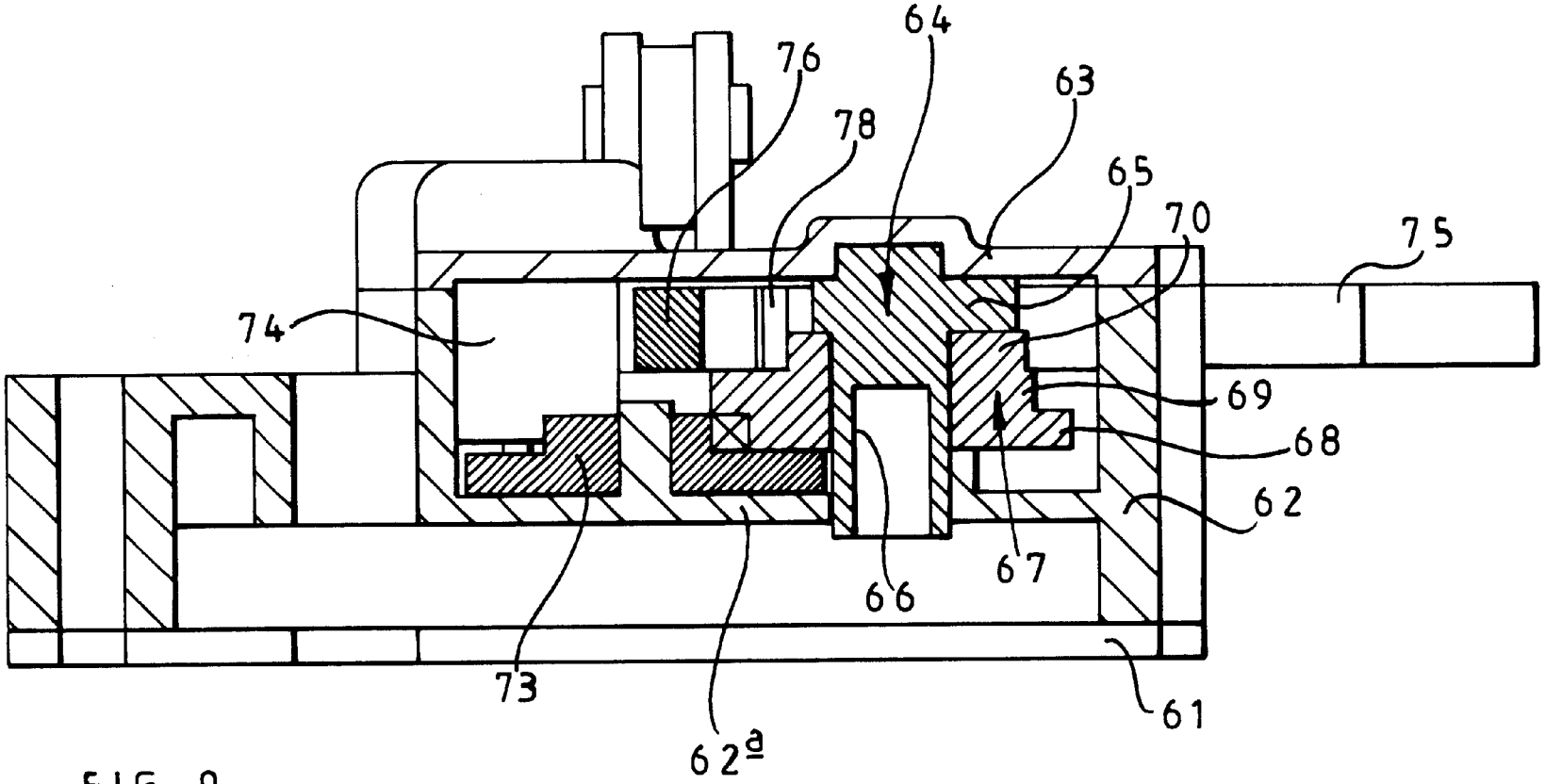
FIG. 9 is a cross-sectional view on the line 9—9 in FIG. 8.

The alternative mechanism illustrated in FIGS. 7 to 9 is intended to replace the conventional door latch mechanism, and to this end the mechanism of FIG. 7 is mounted on a latch plate 61, to be secured inside the door of the vehicle. The latch plate 61 is no larger than the latch plate of a conventional latch mechanism, and ideally it has the same profile and mounting points. A moulded synthetic housing 62 is closed at one end by the plate 61 and may be integral therewith. At its face opposite the plate 61 the housing includes a closure member 63.

Journaled in the housing 62 for rotation about an axis at right angles to the plane of the plate 61 is a door latch release member 64 which comprises a pawl disc 65 lying parallel to the plate 61 and an elongate spindle having a non-circular bore 66 through which the member 64 is coupled to a drive shaft of the latch of the door itself. The arrangement is such that angular movement of the member 64 about its rotational axis in a counterclockwise direction, as viewed in the drawing, drives the latch shaft in a direction to release the latch against a spring bias restoring the latch to its operative condition. The angular throw of the member 64 from a rest position (as shown in the drawings) to release the door latch in use is of the order of 25°.

The member 64 is journaled at one end in an internal wall 62*a* of the housing 62, and at its other end in the closure member 63. The disc 65 is adjacent the member 63, and rotatable on the spindle of the member 64, between the disc 65 and the wall 62*a* of the housing 62 is a cam wheel 67.

The cam wheel 67 has three axially discreet, integral, disc-like zones 68, 69, 70. The first zone 68 defines a gearwheel and is at the axially end of the wheel 67 adjacent the wall 62*a*. The intermediate zone 69 defines a trip disc which in use actuates a microswitch 71, the diameter of the disc 69 being larger than the diameter of the gearwheel 68, and having, in its periphery, notches which cooperate with the trip lever 72 of the microswitch 71. The third zone 70, adjacent the disc 65 of the member 64, is a cam disc.

Journaled for rotation within the housing 62 about an axis parallel to the axis of the member 64 is an intermediate gearwheel 73 having a small diameter region meshing with the gearwheel 68 and an axially spaced, larger diameter region meshing with an output pinion gear of an electric motor 74, carried by the housing 62. It will be recognised therefore that operation of the motor 74 drives the gearwheel 73 which in turn rotates the cam wheel 67 on the spindle of the member 64, but does not drive the member 64. In the example illustrated in the drawings the cam wheel 67 is arranged to be driven in a counter-clockwise direction.

Received in the housing for rectilinear sliding movement tangential to the discs 65, 70 are first and second actuators 75, 76. The actuators 75, 76 are both in the form of moulded synthetic resin rods of square cross-section, disposed at right angles to one another. The actuator 75 projects longitudinally from the housing 62 for connection to the external handle of the vehicle door and the actuator 76 is similarly coupled, through an arrangement which is not shown in the drawings, to the internal door handle. Each of the actuators 75, 76 includes an integral formation pivotally supporting a respective elongate pawl 77, 78. Each pawl is mounted for swinging movement relative to its respective actuator to bring its outer, free end, towards and away from the axis of rotation of the discs 65, 70. Each of the actuators 75, 76 carries a spring finger 77*a*, 78*a* which urges its respective pawl to swing away from the actuator and towards the axis of rotation of the discs 65, 70. Desirably each finger 77*a*, 78*a* will, as shown, be integral with its respective actuator but it is to be recognised that if necessary each finger could be a spring element secured to the actuator. The disc 65 is cut away in two regions to define first and second generally radially extending shoulders 79, 81 spaced apart by 90° around the periphery of the disc 65. Each of the shoulders has a part circular recess in its face for receiving an end region of the respective pawl 77, 78 as will be described in more detail hereinafter. The remainder of the periphery of the disc 65 is circular, and of a diameter slightly less than the outer diameter of the disc 70.

As is seen most clearly in FIGS. 13 to 16 the disc 70 has its periphery defined by two distinct part-circular regions 82, 83 and two inclined shoulders 84, 85 joining the regions 82 and 83. The regions 82 and 83 have their centres of curvature on the axis of rotation of the cam wheel 67 but the region 82, which extends through approximately 180°, is of larger diameter than the region 83 which extends through approximately 160°.

The radius of the region 82 is slightly larger than the radius of the disc 65, and the pawls 77, 78 have a dimension in the direction of the axis of rotation of the cam wheel 67 such that they overlie both the periphery of the disc 65, and the periphery of the disc 70. The radius of the region 83 of the disc 70 is less than the radius of an imaginary circle passing through the recesses in the shoulders 79, 81 and thus while the free ends of the pawls 77, 78 are engaged with the region 82 of the disc 70 they are held, against the action of their springs 77*a*, 78*a* from pivoting movement towards the axis of rotation of the cam wheel 67. However, if the disc 70 is rotated relative to the pawls to a point at which the free end of a pawl engages the surface of the region 83 then that pawl is permitted to swing inwardly under the action of the respective spring to engage the periphery of the disc 65. Provided that the rotational position of the disc 65 is such that the pawls are aligned with the cut away regions defining the shoulders 79, 81 then the ends of the pawls could abut the shoulders 79, 81.

The periphery of the trip disc 69 is shaped in exactly the same way as the periphery of the disc 41 illustrated in FIG. 5, having a projection, a diametrically opposed recess, and intermediate ramps as disclosed at A, B, C, and D in FIG. 5.

Figure 10:
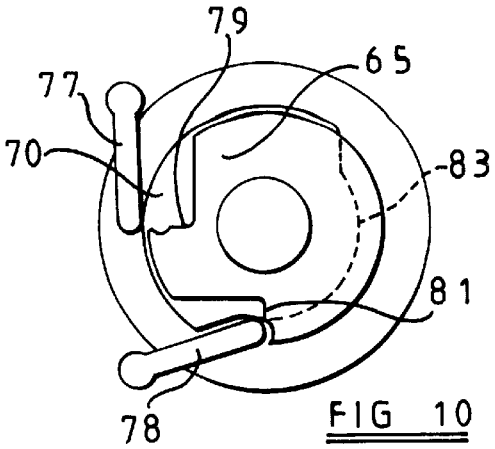
FIG. 10 is a diagrammatic plan view of part of FIG. 8.
Figure 11:
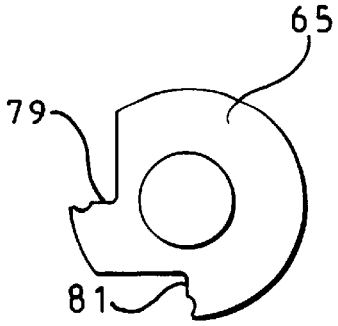
FIGS. 11 and 12 are plan and sectional views respectively of lock operating component of FIG. 8.
Figure 12:
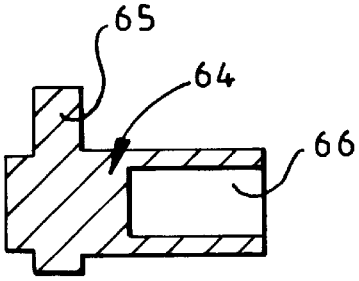
Figure 13:
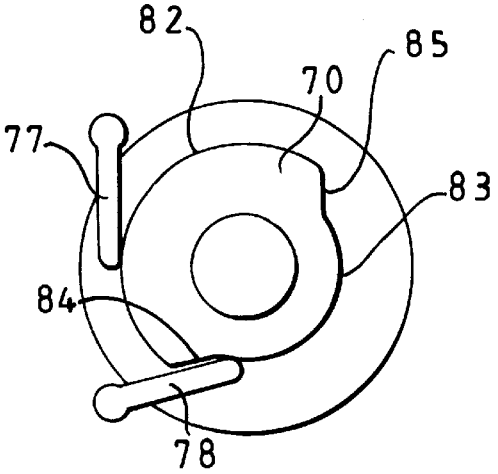
FIGS. 13 to 16 are diagrammatic representations of four consecutive operating positions of mechanism.

The motor 74 is driven in use by way of an electronic control device as described in relation to FIG. 5, the microswitch 71 being actuated by the disc 69 and there being an electronic control device including signal processing means for recognising a change in the state of the microswitch 71 and the duration of the previous state of the microswitch. Thus the trip disc 69 and therefore the cam disc 70 have four operative positions spaced apart by 90° of rotation. FIGS. 13 to 16 illustrate these four positions starting, for convenience, with a position in which the pawl 77 is engaged with the region 82, while the pawl 78 is engaged with the region 83. The disc 65 is in its rest position as shown in FIG. 10, to which it is urged by the return spring of the door latch. The region 83 of the disc 70 permits the pawl 78 to swing inwardly and so lie with its free end closely proximate the recess in the shoulder 81. In this position of the pawl 78, if the actuator 76 is moved by an operating movement of the interior handle of the door, then the displacement of the actuator 76 will be to the right in FIG. 8 and this movement will be transmitted through the pawl 78 to the shoulder 81 so as to displace the disc 65 and thus the member 64 in a counter-clockwise direction. It will be recalled that such movement of the member 64 serves to release the door latch and thus the door can be opened by operating movement of the interior door handle. However, if an attempt is made to open the door by means of the external door handle then the actuator 75 will be moved, but by virtue of the pawl 77 riding on the surface of the region 82 of the disc 70, the pawl will not cooperate with the shoulder 78, and thus movement of the external door handle will not open the door. This is the normal-locked position since the door can be opened from the interior, but not from the exterior.

As described above in relation to FIGS. 1 to 5, the control device associated with the microswitch 71 recognises the current position of the trip disc 69 and determines what operation of the motor 74 is necessary to drive the cam wheel 67, and thus the cam disc 70 to the position demanded by the locking inputs to the control device. The operation of the trip disc 69, the microswitch 71 and the motor 74 are as described above in relation to FIG. 5.

Figure 14:
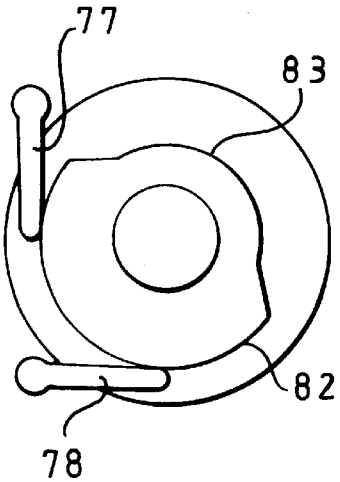

Assuming that the next configuration required is that in which the door is fully locked, then the motor 74 is operated to rotate the mechanism through 90° in a counter-clockwise direction to achieve the position shown in FIG. 14. In this position the pawls 77 and 78 are both held by the region 82 such that they cannot cooperate with their respective shoulders 79, 81, and thus irrespective of movement of the exterior and interior door handles the movement of the actuators 75, 76 will not be transmitted to the disc 65 and the door latch mechanism will remain in its locked position.

Figure 15:
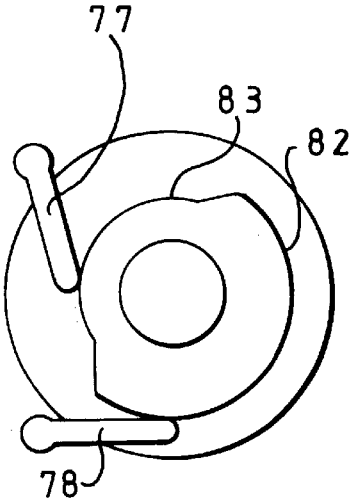

A further 90° of rotation brings the parts to the position shown in FIG. 15 in which the door latch is in child-lock mode. It can be seen that the pawl 77 engages the region 83 of the disc 70 while the pawl 78 remains in engagement with the region 82. Thus the pawl 77 can cooperate with the shoulder 79 when actuated by the exterior door handle, so as to effect release of the vehicle door latch. However, operation of the interior door handle does not affect the latch mechanism since the pawl 78 cannot cooperate with the shoulder 81.

Figure 16:
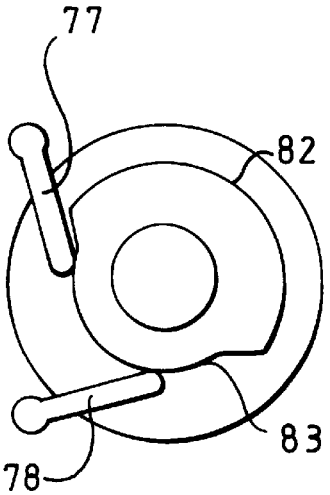

Lastly, a further 90° of rotation brings the parts to the position shown in FIG. 16 which is the unlocked configuration wherein a release movement of either the interior, or the exterior door handle can be transmitted to the disc 65 to release the door latch. Thus in FIG. 16 it can be seen that both pawls are engaged with the region 83, and thus both can cooperate with their respective shoulders 79, 81.

Although the facility is not illustrated in FIGS. 7 to 16, the disc 65 can be modified to incorporate additional shoulders spaced angularly in a counter-clockwise direction from the shoulders 79 and 81, and protruding radially outwardly beyond the periphery of the region 82 of the cam disc 70. Such additional shoulders provide the facility for operation of the latch mechanism of the door as a result of "over-travel" of the interior and/or exterior door handles. This facility may be provided, as described above in relation to FIGS. 1 to 6, to accommodate operation of the latch when the vehicle electrical system has failed. As described above, the "over-travel" positions of the interior and/or exterior door handles will only be permitted to an authorised user. As the additional shoulders protrude beyond the region 82 then the rotated position of the disc 70 is irrelevant to operation in "over-travel" mode.

In a modification of the construction illustrated in FIGS. 7 to 9 the cam wheel 67 is driven directly by the electric motor, the intermediate gearwheel 73 being omitted. The motor can either drive the wheel 67 directly, or through the intermediary of a pinion on the output shaft of the motor meshing with gear teeth on the wheel 67.

As a further alternative the motor 74 may be a stepper motor controlled directly by a control device of the mechanism, thereby dispensing with the microswitch and the trip disc 69. The stepper motor would be driven by way of a conventional stepper motor driver circuit and would receive inputs from the control device of the mechanism to cause the stepper motor to step to predetermined positions, to achieve the locking configuration demanded by the control device in accordance with the locking inputs received thereby. The control device, and the stepper motor drive circuit can be incorporated in the housing 62, and where the motor drives the cam wheel directly, it will be preferred to use a stepper motor. It will be recognised that the control signals to the stepper motor drive circuit can be encrypted as part of the overall security system of the vehicle. Authorised operation of the vehicle will generate a "key" which is sent to the encryption/un-encryption circuitry, to permit the encrypted signals to be decoded and so to operate the stepper motor.

In a still further modification the motor 74 and gearing is replaced by a solenoid the plunger of which is coupled to the cam wheel 67 through a ratchet mechanism or the like whereby each full stroke of the plunger of the solenoid generates 90° of rotation of the mechanism. The control device of the mechanism will supply operating pulses to the solenoid to step the mechanism in a counter-clockwise direction, in 90° steps, to achieve the desired locking configuration.

It will be understood that where appropriate the modifications and alternatives described above in relation to FIGS. 1 to 6 can be applied to the mechanism of FIGS. 7 to 16.

What is claimed is:

1. A vehicle door locking system including a latch mechanism having an operative condition and a release condition, an external manually operable control for moving the latch mechanism from said operative condition to said release condition, first controllable coupling means for determining whether or not operation of said external control is transmitted to said latch mechanism to move said latch mechanism from said operative condition to said release condition, an internal manually operable control for moving the latch mechanism from said operative condition to said release condition, second controllable coupling means for determining whether or not operation of said internal control is transmitted to said latch mechanism to move said latch mechanism from said operative condition to said release condition, and a control arrangement responsive to predetermined locking input signals for determining when said first and second controllable coupling means are operative to transmit movement of said respective controls to the latch mechanism, each said coupling means including a moveable coupling pin for establishing a driving connection between a respective input member moveable by the respective manually operable control and an output member driving said latch mechanism.

2. A vehicle door locking system as claimed in claim 1 wherein said control arrangement is an electromechanical arrangement arranged to receive electrical locking input signals.

3. A vehicle door locking system as claimed in claim 1 wherein the first and second controllable coupling means are each mechanical coupling means.

4. A vehicle door locking system as claimed in claim 1 wherein said control arrangement includes a movable cam member common to both coupling means, for determining when each coupling means is operative.

5. A vehicle door locking system as claimed in claim 4 wherein said cam member is a rotatable cam.

6. A vehicle door locking system as claimed in claim 5 wherein said cam member is, in use, rotated only in one direction.

7. A vehicle door locking system as claimed in claim 4 wherein each said coupling means comprises a moveable pawl spring biased to a position in which it provides a mechanical connection between an input member moveable by the respective manually operable control and an output member for moving said latch mechanism, and said cam means selectively prevents the pawl moving under the action of its resilient means so as to prevent connection between the manually operable control and the latch mechanism.

8. A vehicle door locking system as claimed in claim 1 wherein there is provided means, available to an authorised user, for overriding the action of the control arrangement and thus permitting the or each manually operable control to release said latch mechanism.

9. A vehicle door locking system as claimed in claim 8 wherein said means includes a mechanical coupling actuated by movement of the or each manual control beyond its normally permitted range of movement.

10. A vehicle locking system as claimed in claim 1 in combination with a vehicle crash sensor wherein the control arrangement of the locking system is adapted to accept a signal from said vehicle crash sensor and the use of such signal to operate the system to ensure that said interior manually operable control is coupled to said latch mechanism.

11. A vehicle locking system as claimed in claim 1 wherein there is provided means for encrypting the signals supplied to the control arrangement and a decoding system which must be initialised by a security code signal supplied by the vehicle's security system before the signals to the control arrangement can be decoded and implemented.

12. A vehicle door locking system including a latch mechanism having an operative condition and a release condition, an external manually operable control for moving the latch mechanism from said operative condition to said release condition, first controllable coupling means for determining whether or not operation of said external control is transmitted to said latch mechanism to move said latch mechanism from said operative condition to said release condition, an internal manually operable control for moving the latch mechanism from said operative condition to said release condition, second controllable coupling means for determining whether or not operation of said internal control is transmitted to said latch mechanism to move said latch mechanism from said operative condition to said release condition, and a control arrangement responsive to predetermined locking input signals for determining when said first and second controllable coupling means are operative to transmit movement of said respective controls to the latch mechanism, said control arrangement including a rotatable cam member common to both coupling means, for determining when each coupling means is operative, said rotatable cam member being rotatable only in one direction.

13. A vehicle door locking system including a latch mechanism having an operative condition and a release condition, an external manually operable control for moving the latch mechanism from said operative condition to said release condition, first controllable coupling means for determining whether or not operation of said external control is transmitted to said latch mechanism to move said latch mechanism from said operative condition to said release condition, an internal manually operable control for moving the latch mechanism from said operative condition to said release condition, second controllable coupling means for determining whether or not operation of said internal control is transmitted to said latch mechanism to move said latch mechanism from said operative condition to said release condition, a control arrangement responsive to predetermined locking input signals for determining when said first and second controllable coupling means are operative to transmit movement of said respective controls to the latch mechanism, means for encrypting the signals supplied to the control arrangement, and, a decoding system which must be initialised by a security code signal supplied by a security system of the vehicle before the signals to the control arrangement can be decoded and implemented.

* * * * *